US008315854B2

(12) United States Patent
Oh et al.

(10) Patent No.: US 8,315,854 B2
(45) Date of Patent: Nov. 20, 2012

(54) METHOD AND APPARATUS FOR DETECTING PITCH BY USING SPECTRAL AUTO-CORRELATION

(75) Inventors: Kwang Cheol Oh, Seongnam-si (KR); Jae-Hoon Jeong, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 975 days.

(21) Appl. No.: 11/604,272

(22) Filed: Nov. 27, 2006

(65) Prior Publication Data

US 2007/0174048 A1 Jul. 26, 2007

(30) Foreign Application Priority Data

Jan. 26, 2006 (KR) ..... 10-2006-0008161

(51) Int. Cl.
*G10L 11/04* (2006.01)
*G10L 11/06* (2006.01)
*G10L 19/00* (2006.01)

(52) U.S. Cl. ..... 704/207; 704/208; 704/217

(58) Field of Classification Search ..... 704/200, 704/205–209, 217, 224
See application file for complete search history.

(56) References Cited

U.S. PATENT DOCUMENTS 4,935,963 A * 6/1990 Jain ..... 704/207
5,086,475 A * 2/1992 Kutaragi et al. ..... 704/265
5,121,428 A * 6/1992 Uchiyama et al. ..... 704/243
5,764,779 A * 6/1998 Haranishi ..... 381/71.1
6,018,706 A * 1/2000 Huang et al. ..... 704/207
6,115,684 A * 9/2000 Kawahara et al. ..... 704/203
6,124,544 A * 9/2000 Alexander et al. ..... 84/616
6,188,979 B1 2/2001 Ashley
6,208,958 B1 3/2001 Cho et al.
6,418,407 B1 7/2002 Huang et al.
6,453,284 B1 9/2002 Paschall
6,587,816 B1 7/2003 Chazan et al.
6,732,075 B1 * 5/2004 Omori et al. ..... 704/250
6,745,155 B1 * 6/2004 Andringa et al. ..... 702/189
6,772,126 B1 * 8/2004 Simpson et al. ..... 704/500
7,013,267 B1 * 3/2006 Huart et al. ..... 704/207
7,180,892 B1 * 2/2007 Tackin ..... 370/389

(Continued)

FOREIGN PATENT DOCUMENTS

KR 10-0421817 2/2004

OTHER PUBLICATIONS

Shimamura et al, "Weighted autocorrelation for pitch extraction of noisy speech," IEEE Trans. Speech, and Audio Processing, vol. 9, No. 7, 2001, pp. 727-730.*
Buchler. "Algorithms for Sound Classification in Hearing Instruments". PhD thesis, ETH Zurich, 2002, pp. 1-137.*

(Continued)

*Primary Examiner* — Samuel G Neway
(74) *Attorney, Agent, or Firm* — Staas & Halsey LLP

(57) ABSTRACT

A method and an apparatus for detecting a pitch in input voice signals by using a spectral auto-correlation. The pitch detection method includes: performing a Fourier transform on the input voice signals after performing a pre-processing on the input voice signals, performing an interpolation on the transformed voice signals, calculating a spectral difference from a difference between spectrums of the interpolated voice signals, calculating a spectral auto-correlation by using the calculated spectral difference, determining a voicing region based on the calculated spectral auto-correlation, and extracting a pitch by using the spectral auto-correlation corresponding to the voicing region.

8 Claims, 7 Drawing Sheets

U.S. PATENT DOCUMENTS

| | | | | |
|---|---|---|---|---|
| 2004/0044533 | A1* | 3/2004 | Najaf-Zadeh et al. | 704/500 |
| 2005/0021325 | A1* | 1/2005 | Seo et al. | 704/207 |
| 2005/0102133 | A1* | 5/2005 | Rees | 704/205 |
| 2005/0149321 | A1* | 7/2005 | Kabi et al. | 704/207 |
| 2006/0053007 | A1* | 3/2006 | Niemisto | 704/233 |
| 2007/0174049 | A1* | 7/2007 | Oh et al. | 704/207 |

OTHER PUBLICATIONS

Xuejing Sun, "Pitch Determination and Voice Quality Analysis Using Subharmonic-to-Harmonic Ratio", Department of Communication Sciences and Disorders, Northwestern University, 2000 IEEE, pp. 333-336.

* cited by examiner

SPECTRUM OBTAINED FROM A SINGLE FRAME OF MAN'S VOICE WITH NOISE (UP TO 1.5 KHZ)

INTERPOLATION

DIFFERENCE

NORMALIZED LOCAL CENTER OF GRAVITY

METHOD AND APPARATUS FOR DETECTING PITCH BY USING SPECTRAL AUTO-CORRELATION

CROSS-REFERENCE TO RELATED APPLICATION

This application claims priority from Korean Patent Application No. 10-2006-0008161, filed on Jan. 26, 2006, in the Korean Intellectual Property Office, the disclosure of which is incorporated herein by reference.

BACKGROUND OF THE INVENTION

1. Field of the Invention

The present invention relates to a method and an apparatus for detecting a pitch in input voice signals by using a spectral auto-correlation.

2. Description of Related Art

In the field of voice signal processing such as speech recognition, voice synthesis, and analysis, it is important to exactly extract a basic frequency, i.e. a pitch cycle. The exact extraction of the basic frequency may enhance recognition accuracy through reduced speaker-dependent speech recognition, and also easily alter or maintain naturalness and personality in voice synthesis. Additionally, voice analysis synchronized with a pitch may allow for obtaining a correct vocal track parameter from which effects of glottis are removed.

For the above reasons, a variety of ways of implementing a pitch detection in a voice signal have been proposed. Such conventional proposals may be divided into a time domain detection method, a frequency domain detection method, and a time-frequency hybrid domain detection method.

The time domain detection method, such as parallel processing, average magnitude difference function (AMDF), and auto-correlation method (ACM), is a technique to extract a pitch by decision logic after emphasizing periodicity of a waveform. Being performed mostly in a time domain, this method may require only a simple operation such as an addition, a subtraction, and a comparison logic without requiring a domain conversion. However, when a phoneme ranges over a transition region, the pitch detection may be difficult due to excessive variations of a level in a frame and fluctuations in a pitch cycle, and also may be much influenced by formant. Especially, in the case of a noise-mixed voice, a complicated decision logic for the pitch detection may increase unfavorable errors in extraction.

The frequency domain detection method is a technique to extract a basic frequency of voicing by measuring a harmonics interval in a speech spectrum. A harmonics analysis technique, a lifter technique, a comb-filtering technique, etc., have been proposed as such methods. Generally, a spectrum is obtained according to a frame unit. So, even if a transition or variation of a phoneme or a background noise appears, this method may be not much affected since it may average out. However, calculations may become complicated because a conversion to a frequency domain is required for processing. Also, if pointers of a Fast Fourier Transform (FFT) increase in number to raise the precision of the basic frequency, a calculation time required is increased while being insensitive to variation characteristics.

The time-frequency hybrid domain detection method combines the merits of the aforementioned methods, that is, a short calculation time and high precision of the pitch in the time domain detection method and the ability to exactly extract pitch despite a background noise or a phoneme variation in the frequency domain detection method. This hybrid method, for example, includes a cepstrum technique and a spectrum comparison technique, may invite errors while performed between time and frequency domains, thus unfavorably influencing pitch extraction. Also, a double use of the time and frequency domains may create a complicated calculation process.

BRIEF SUMMARY

An aspect of the present invention provides a method for detecting a pitch in input voice signals by using a spectral difference and its spectral auto-correlation like time domain signals. Another aspect of the present invention provides a method for detecting a pitch in input voice signals by using normalized local center of gravity and its spectral auto-correlation like time domain signals. Still another aspect of the present invention provides an apparatus that executes the above methods.

One aspect of the present invention provides a pitch detection apparatus, which includes: a pre-processing unit performing a predetermined pre-processing on input voice signals, a Fourier transform unit performing a Fourier transform on the pre-processed voice signals, an interpolation unit performing an interpolation on the transformed voice signals, a spectral difference calculation unit calculating a spectral difference from a difference between spectrums of the interpolated voice signals, a spectral auto-correlation calculation unit calculating a spectral auto-correlation by using the calculated spectral difference, a voicing region decision unit determining a voicing region based on the calculated spectral auto-correlation, and a pitch extraction unit extracting a pitch by using the spectral auto-correlation corresponding to the voicing region.

Another aspect of the invention provides a pitch detection apparatus, which includes: a pre-processing unit performing a predetermined pre-processing on input voice signals, a Fourier transform unit performing a Fourier transform on the pre-processed voice signals, an interpolation unit performing an interpolation on the transformed voice signals, a normalized local center of gravity (NLCG) calculation unit calculating an NLCG on a spectrum of the interpolated voice signals, a spectral auto-correlation calculation unit calculating a spectral auto-correlation by using the calculated NLCG, a voicing region decision unit determining a voicing region based on the calculated spectral auto-correlation, and a pitch extraction unit extracting a pitch by using the spectral auto-correlation corresponding to the voicing region.

Another aspect of the invention provides a pitch detection method, which includes: performing a Fourier transform on input voice signals after performing a predetermined pre-processing on the input voice signals, performing an interpolation on the transformed voice signals, calculating a spectral difference from a difference between spectrums of the interpolated voice signals, calculating a spectral auto-correlation by using the calculated spectral difference, determining a voicing region based on the calculated spectral auto-correlation, and extracting a pitch by using the spectral auto-correlation corresponding to the voicing region.

Still another aspect of the invention provides a pitch detection method, which includes: performing a Fourier transform on input voice signals after performing a pre-processing on the input voice signals, performing an interpolation on the transformed voice signals, calculating a normalized local center of gravity (NLCG) on a spectrum of the interpolated voice signals, calculating spectral auto-correlation by using the calculated NLCG, determining a voicing region based on the calculated spectral auto-correlation, and extracting a pitch by using the spectral auto-correlation corresponding to the voicing region.

According to an aspect of the present invention, there is provided a method of detecting a pitch in input voice signals, the method including: Fourier transforming the input voice signals after the input voice signals are pre-processed; interpolating the transformed voice signals; calculating a spectral difference from a difference between spectrums of the interpolated voice signals; calculating a spectral auto-correlation using the calculated spectral difference; determining a voicing region based on the calculated spectral auto-correlation; and extracting a pitch using a spectral auto-correlation corresponding to the voicing region.

According to other aspects of the present invention, there are provided computer-readable storage media encoded with processing instructions for causing a processor to execute the aforementioned methods.

Additional and/or other aspects and advantages of the present invention will be set forth in part in the description which follows and, in part, will be obvious from the description, or may be learned by practice of the invention.

BRIEF DESCRIPTION OF THE DRAWINGS

The above and/or other aspects and advantages of the present invention will become apparent and more readily appreciated from the following detailed description, taken in conjunction with the accompanying drawings of which.

DETAILED DESCRIPTION OF EMBODIMENTS

Figure 1:
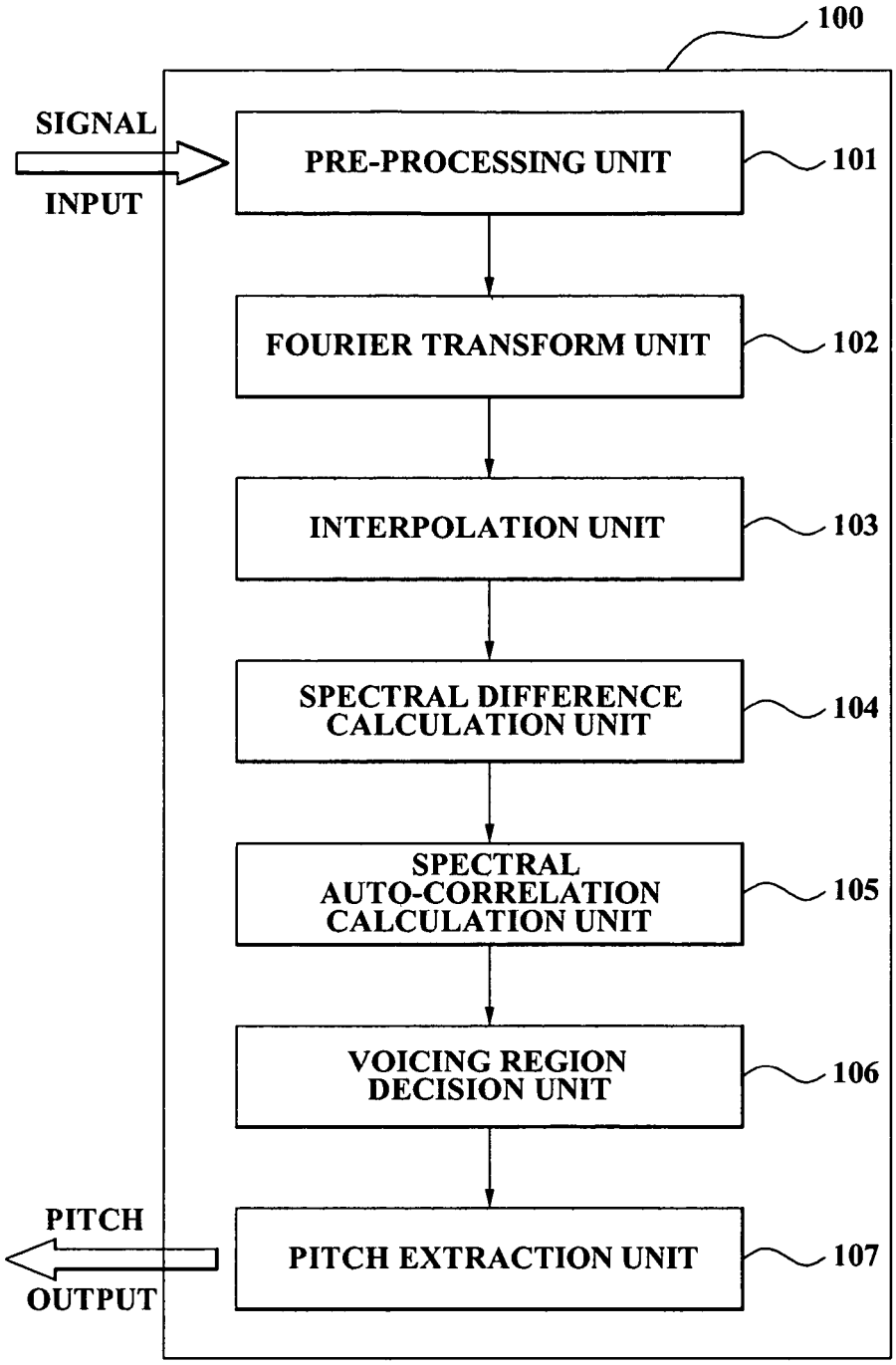
FIG. 1 is a block diagram illustrating a pitch detection apparatus according to an embodiment of the present invention.

Reference will now be made in detail to exemplary embodiments of the present invention, examples of which are illustrated in the accompanying drawings, wherein like reference numerals refer to the like elements throughout. The exemplary embodiments are described below in order to explain the present invention by referring to the figures.

FIG. 1 is a block diagram illustrating a pitch detection apparatus 100 according to an embodiment of the present invention.

As shown in FIG. 1, the pitch detection apparatus 100 includes a pre-processing unit 101, a Fourier transform unit 102, an interpolation unit 103, a spectral difference calculation unit 104, a spectral auto-correlation calculation unit 105, a voicing region decision unit 106, and a pitch extraction unit 107.

The pitch detection apparatus 100 detects a pitch in input voice signals by using a spectral difference and its spectral auto-correlation. A waveform of the spectral difference appears in a shape similar to the waveform in a time domain. A graph of a spectral auto-correlation calculated by using a spectral difference represents peaks corresponding to pitch frequencies.

Figure 2:
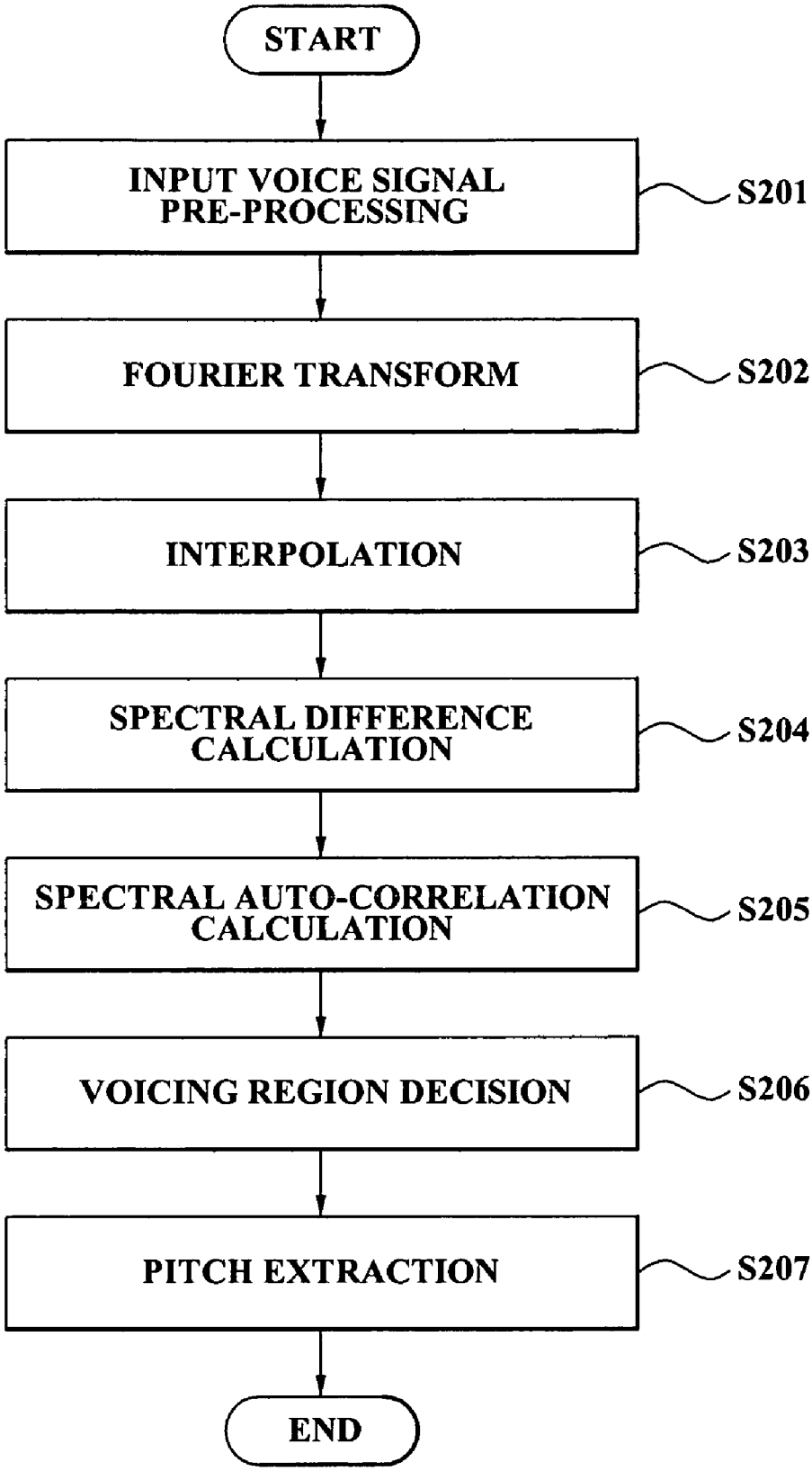
FIG. 2 is a flowchart illustrating a pitch detection method utilizing the apparatus of FIG. 1.

FIG. 2 is a flowchart illustrating a pitch detection method utilizing, by way of a non-limiting example, the apparatus shown in FIG. 1.

Referring to FIGS. 1 and 2, in a first operation S201, the pre-processing unit 101 performs a predetermined pre-processing on input voice signals. In a next operation S202, the Fourier transform unit 102 performs a Fourier transform on the pre-processed voice signals as shown in Equation 1.

$$A(f) = A(e^{j2\pi k/N}) = \sum_{n=0}^{N-1} s(n)e^{j2\pi k/N} \quad \text{[Equation 1]}$$

In a next operation S203, the interpolation unit 103 performs an interpolation on the transformed voice signals as shown in the following Equation 2.

$$A(f_k) \Rightarrow A(f_i) \quad \text{[Equation 2]}$$

Here, $k=1, 2, \ldots, L_k$, $i=1, 2, \ldots, L_i$, and $R=L_i/L_k$

In this operation S203, the interpolation unit 103 performs a low-pass interpolation with regard to amplitudes corresponding to low-pass frequencies, e.g. 0~1.5 kHz, and may also re-sample sequence to correspond to R ($L_i/L_k$) times of an initial sample rate as shown in equation 2. Such interpolation may reduce a drop in a resolution due to narrower sample intervals, and also improve a frequency resolution.

In a next operation S204, the spectral difference calculation unit 104 calculates a spectral difference from a difference between frequencies in a spectrum of transformed and interpolated voice signals. This is shown in Equation 3.

$$dA(f_i)=A(f_i)-A(f_{i-1}) \quad \text{[Equation 3]}$$

In this operation S204, the spectral difference calculation unit 104 may calculate a spectral difference by a positive difference of a spectrum. The waveform of the calculated spectral difference is in a shape similar to the waveform in a time region.

In a next operation S205, the spectral auto-correlation calculation unit 105 calculates spectral auto-correlation by using the calculated spectral difference. Here, the spectral auto-correlation calculation unit 105 uses the calculated spectral difference and then calculates a spectral auto-correlation by performing a normalization as shown in Equation 4.

$$sa(f_\tau) = \sum_i dA(f_i)\cdot dA(f_{i-\tau}) \Big/ \sum_i dA(f_i)\cdot dA(f_i) \quad \text{[Equation 4]}$$

In a next operation S206, the voicing region decision unit 106 determines a voicing region by means of a frequency component of the calculated spectral auto-correlation. Here, the voicing region decision unit 106 compares a maximum of the calculated spectral auto-correlation with a predetermined value Tsa. Then, as shown in Equation 5, a region in which the maximum spectral auto-correlation is greater than the predetermined value is determined as the voicing region.

$$\text{voiced if } \max\{sa(f_\tau)\} > T_{sa}$$

$$\text{unvoiced if } \max\{sa(f_\tau)\} < T_{sa} \quad \text{[Equation 5]}$$

In a next operation S207, the pitch extraction unit 107 extracts a pitch by using the spectral auto-correlation corresponding to the voicing region as shown in Equation 6.

$$P = \max_{\tau}\{sa(f_\tau)\} \text{ if voiced} \quad \text{[Equation 6]}$$

In this operation S207, the pitch extraction unit 107 may extract the pitch by performing a parabolic interpolation or a sync function interpolation to the spectral auto-correlation corresponding to the voicing region. Namely, the pitch extraction unit 107 may obtain the pitch from the position of a local peak corresponding to the maximum spectral auto-correlation among interpolated spectral auto-correlations.

Figure 3:
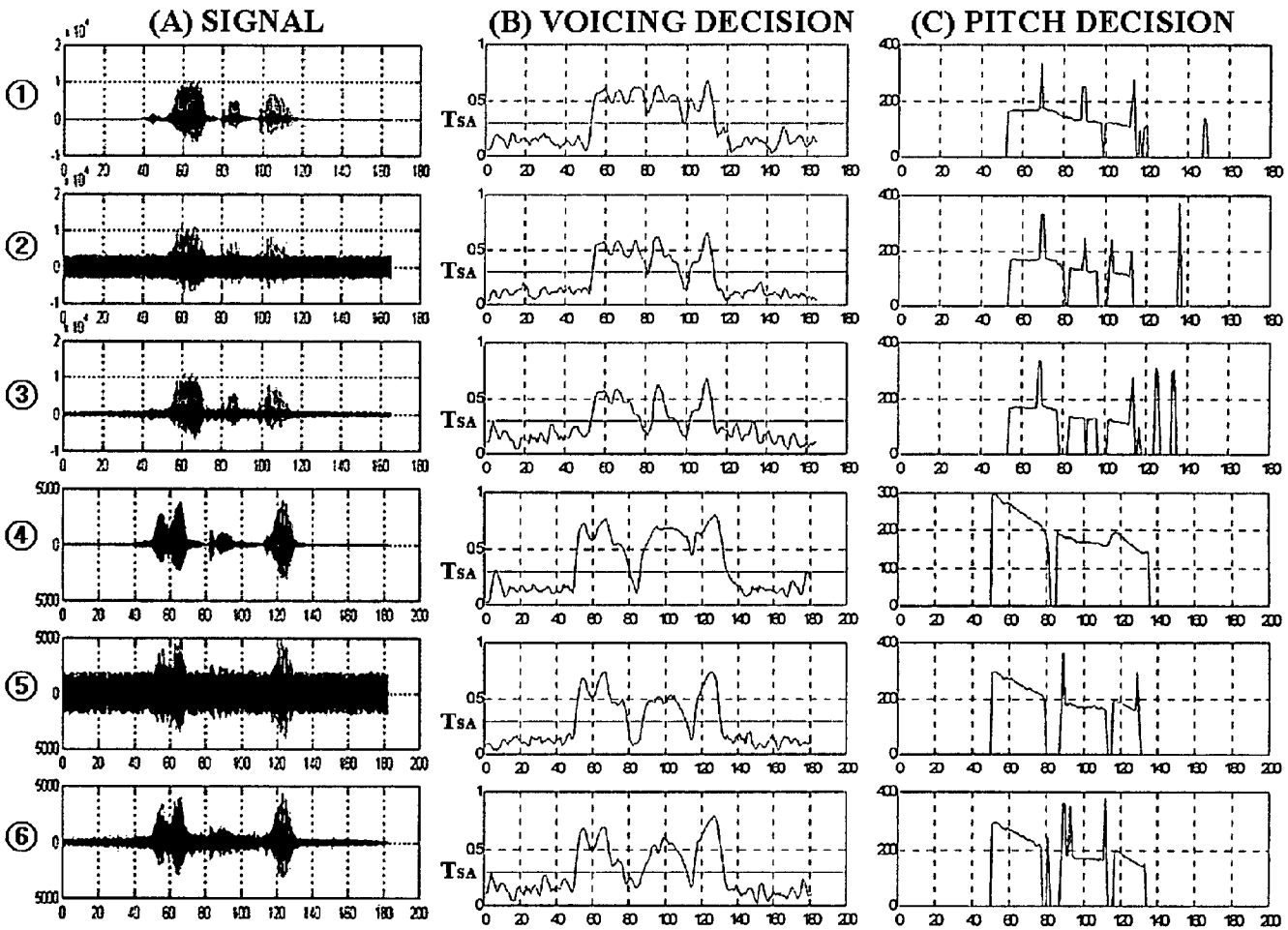
FIG. 3, parts (a)-(c), is a view illustrating resultant waveforms obtained from experiments utilizing the method of FIG. 2.

FIG. 3 is a view illustrating resultant waveforms obtained from experiments utilizing the method of FIG. 2.

In FIG. 3, part (a) represents input signals. Specifically, 1 is a man's voice signal, 2 is a mixed signal of the man's voice and a white noise, and 3 is a mixed signal of the man's voice and an airplane noise. Also, 4 is a woman's voice signal, 5 is a mixed signal of the woman's voice and a white noise, and 6 is a mixed signal of the woman's voice and an airplane noise.

Furthermore, parts (b) and (c) in FIG. 3 illustrate waveforms after the respective input signals are processed by the above-described method shown in FIG. 2. Specifically, part (b) shows a step of determining the voicing region by using both the calculated spectral auto-correlation and a predetermined value $T_{sa}$. Finally, part (c) shows a result of extracting the pitch by using the spectral auto-correlation corresponding to the voicing region.

Figure 4:
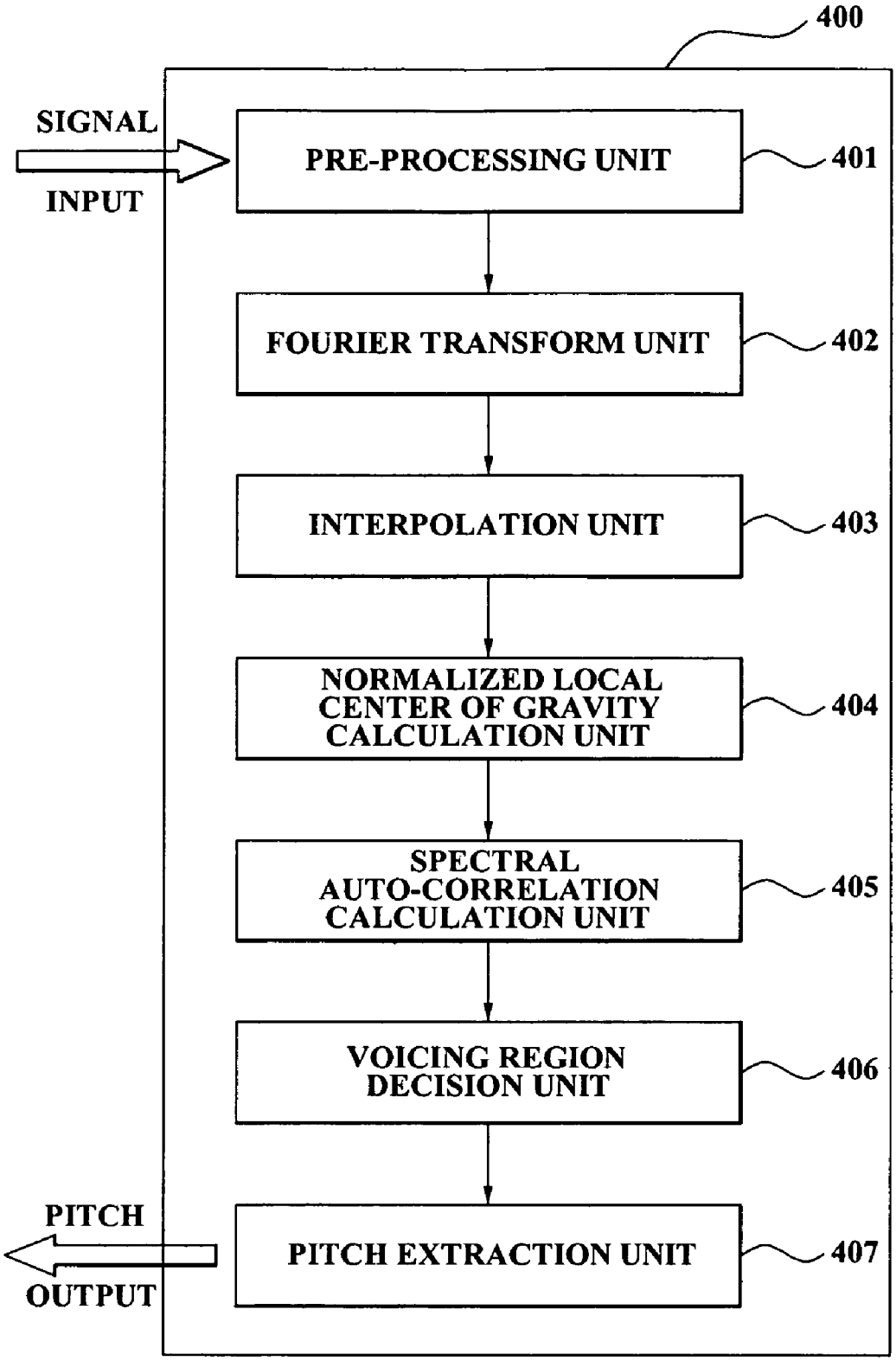
FIG. 4 is a block diagram illustrating a pitch detection apparatus according to another embodiment of the present invention.

FIG. 4 is a block diagram illustrating a pitch detection apparatus according to another embodiment of the present invention.

As shown in FIG. 4, the pitch detection apparatus 400 of the present embodiment includes a pre-processing unit 401, a Fourier transform unit 402, an interpolation unit 403, a normalized local center of gravity calculation unit 404, a spectral auto-correlation calculation unit 405, a voicing region decision unit 406, and a pitch extraction unit 407.

The pitch detection apparatus 400 detects a pitch in input voice signals by using a normalized local center of gravity and its spectral auto-correlation. The waveform of the normalized local center of gravity appears in a shape similar to the waveform in a time domain. Moreover, a periodic structure of harmonics may be effectively preserved in comparison with the previous embodiment. A graph of spectral auto-correlation calculated by using the normalized local center of gravity represents peaks corresponding to pitch frequencies.

Figure 5:
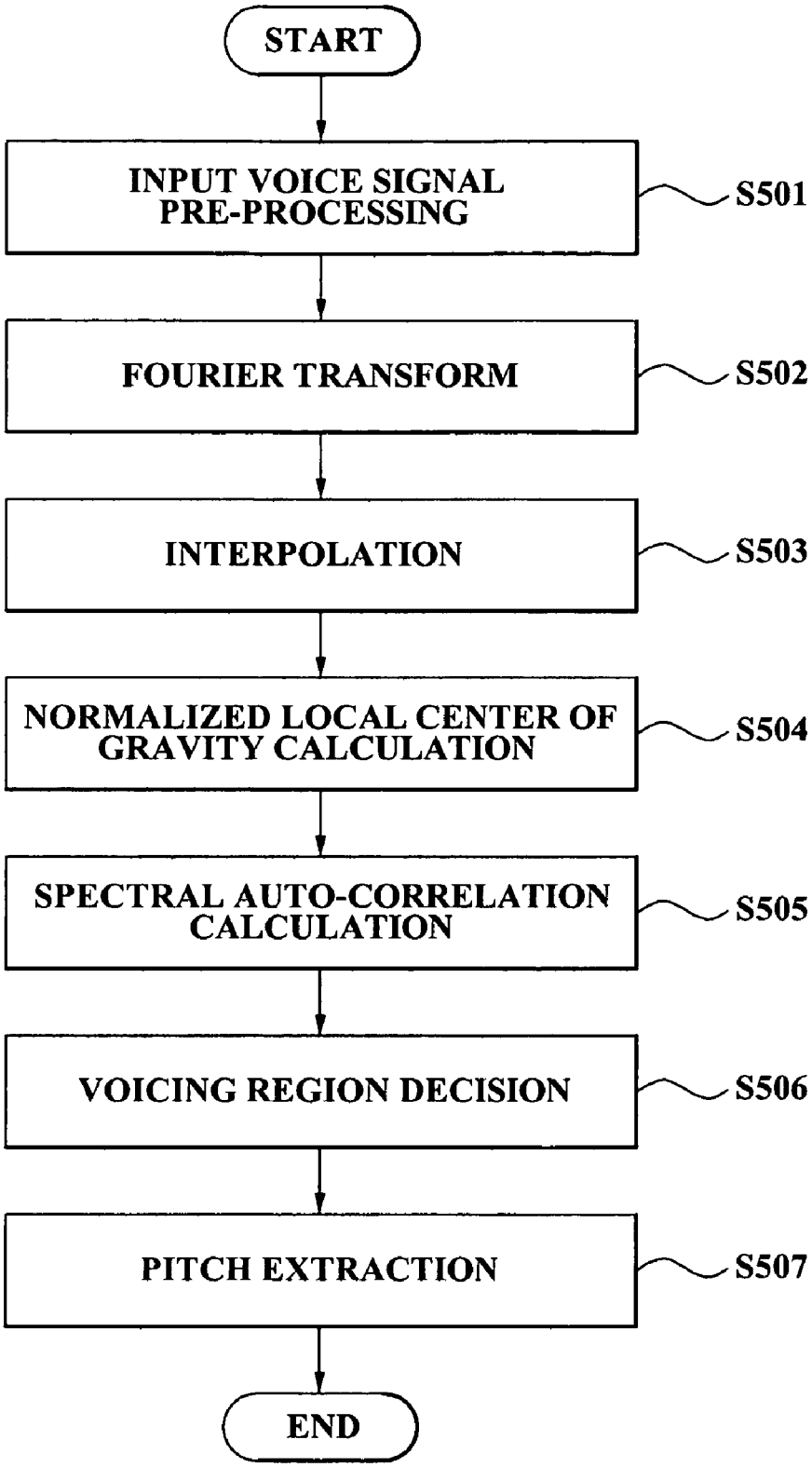
FIG. 5 is a flowchart illustrating a pitch detection method utilizing the apparatus of FIG. 4.

FIG. 5 is a flowchart illustrating a pitch detection method utilizing, by way of a non-limiting example, the apparatus shown in FIG. 4.

Referring to FIGS. 4 and 5, in a first operation S501, the pre-processing unit 401 performs a predetermined pre-processing on input voice signals. In a next operation S502, the Fourier transform unit 402 performs a Fourier transform on the pre-processed voice signals as set forth in the above Equation 1.

In a next operation S503, the interpolation unit 403 performs interpolation on the transformed voice signals as set forth in the above Equation 2. Here, the interpolation unit 403 performs a low-pass interpolation with regard to amplitudes corresponding to low-pass frequencies, e.g. 0-1.5 kHz, and may also re-sample a sequence to correspond to R ($L_t/L_k$) times of an initial sample rate as shown in the above Equation 2. Such interpolation may reduce a drop in resolution due to narrower sample intervals, and also improve a frequency resolution.

In a next operation S504, the normalized local center of gravity calculation unit 404 calculates a normalized local center of gravity (NLCG) on spectrum of transformed and interpolated voice signals. This is shown in the following Equation 7.

$$cA(f_i) = \frac{1}{U}\frac{\sum_{j=1}^{j=U} iA(f_{i-U/2+j})}{\sum_{j=1}^{j=U} A(f_{i-U/2+j})} - 0.5 \quad \text{[Equation 7]}$$

Here, a symbol U represents a local region. The waveform of the calculated NLCG is in a shape similar to the waveform in time region. Moreover, a periodic structure of harmonics may be effectively preserved in the present embodiment, as compared with the previous embodiment.

In a next operation S505, the spectral auto-correlation calculation unit 405 calculates spectral auto-correlation by using the calculated NLCG. This is shown in the following Equation 8.

$$sa(f_\tau) = \sum_i cA(f_i)\cdot cA(f_{i-\tau}) \quad \text{[Equation 8]}$$

Here, contrary to the previous embodiment, the spectral auto-correlation calculation unit 405 does not separately perform normalization. The reason is that normalization has been already performed in the above-discussed NLCG calculation step.

In a next operation S506, the voicing region decision unit 406 determines a voicing region based on the calculated spectral auto-correlation. Here, the voicing region decision unit 406 compares a maximum spectral auto-correlation with a predetermined value as shown in the above Equation 5. Then a region in which the maximum spectral auto-correlation is greater than the predetermined value is determined as the voicing region.

In a next operation S507, the pitch extraction unit 407 extracts a pitch by using the spectral auto-correlation corresponding to the voicing region as shown in the above Equation 6. Here, the pitch extraction unit 407 may extract the pitch by performing a parabolic interpolation or a sync function interpolation to the spectral auto-correlation corresponding to the voicing region. That is, the pitch extraction unit 407 may obtain the pitch from a position of a local peak corresponding to the maximum spectral auto-correlation among interpolated spectral auto-correlations.

Figure 6:
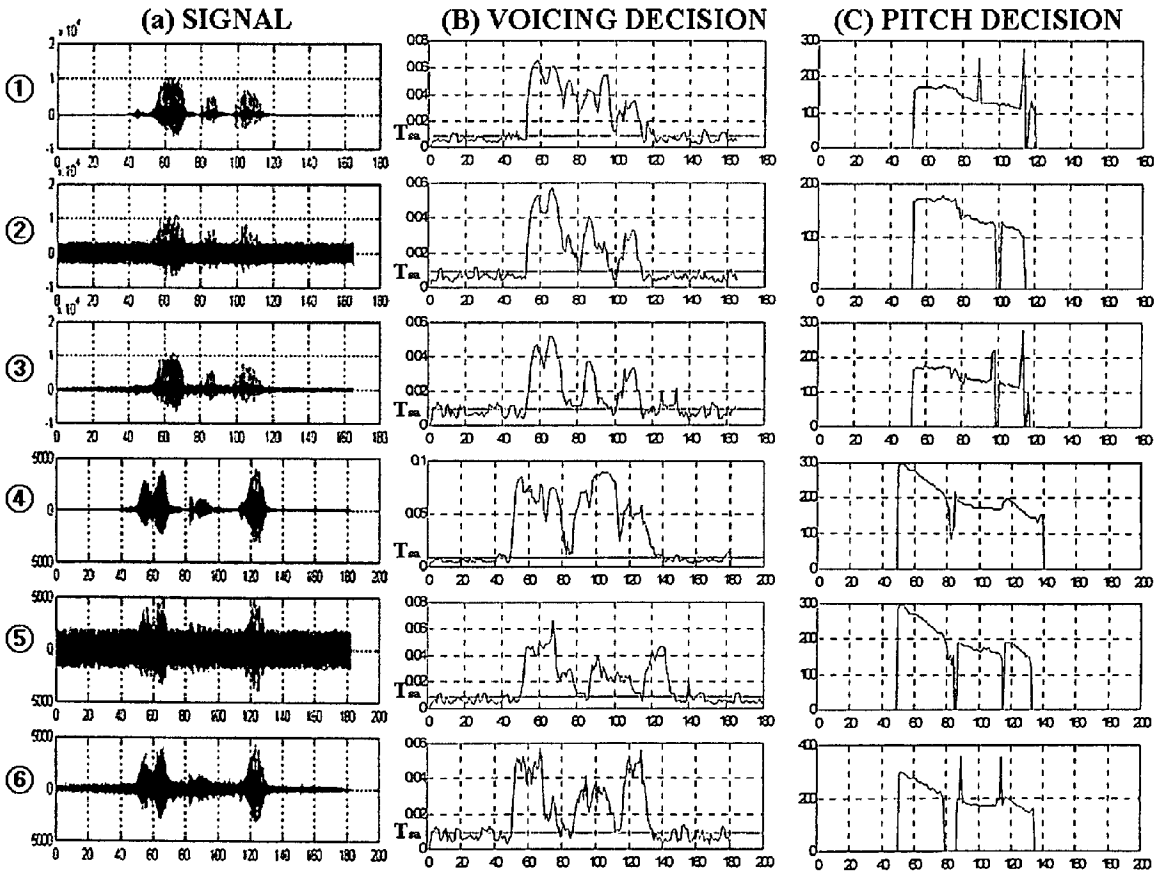
FIG. 6, parts (a)-(c), is a view illustrating resultant waveforms obtained from experiments utilizing the method of FIG. 5.

FIG. 6 is a view illustrating resultant waveforms obtained by experiment utilizing the method of FIG. 5.

In FIG. 6, part (a) represents input signals. Specifically, 1 is a man's voice signal, 2 is a mixed signal of the man's voice and a white noise, and 3 is a mixed signal of the man's voice and an airplane noise. Also, 4 is a woman's voice signal, 5 is a mixed signal of the woman's voice and a white noise, and 6 is a mixed signal of the woman's voice and an airplane noise.

Furthermore, parts (b) and (c) in FIG. 6 illustrate waveforms after the respective input signals are processed by the above-described method shown in FIG. 5. Specifically, part (b) shows a step of determining the voicing region by using both the calculated spectral auto-correlation and a predetermined value $T_{sa}$. Finally, part (c) shows a result of extracting the pitch by using the spectral auto-correlation corresponding to the voicing region.

FIGS. 7A-D are views for comparing waveforms between spectral difference and normalized local center of gravity.

Figure 7A:
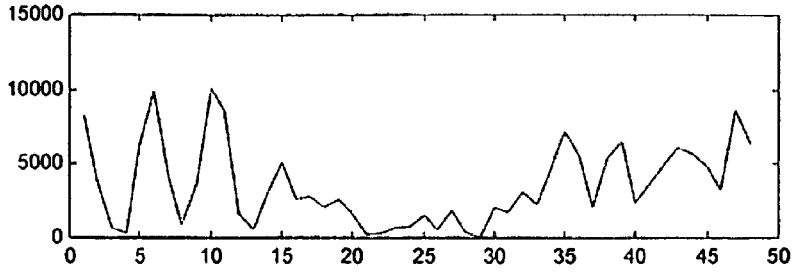
FIGS. 7A-7D are views for comparing waveform between spectral difference and normalized local center of gravity.
Figure 7B:
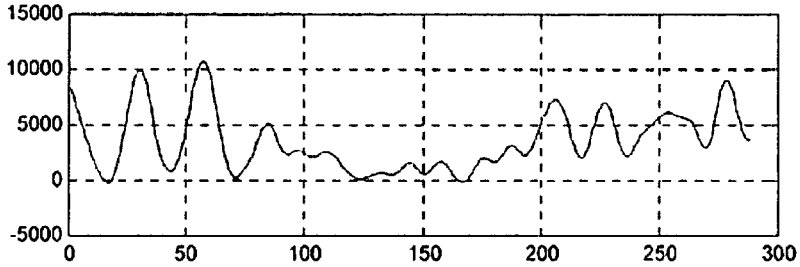

FIG. 7A shows a waveform of spectrum (up to 1.5 kHz) obtained from a single frame of man's voice with noise. FIG. 7B further shows an interpolated waveform, a waveform calculated by a spectral difference, and a waveform calculated by an NLCG.

Figure 7C:
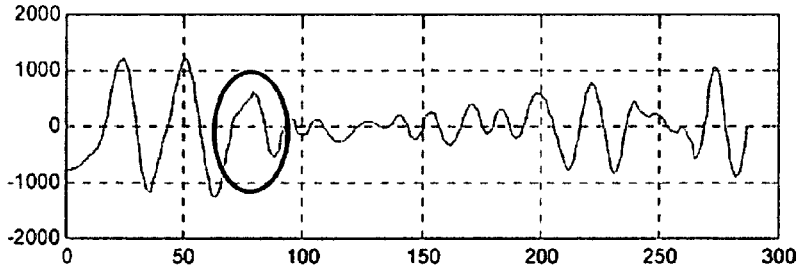
Figure 7D:
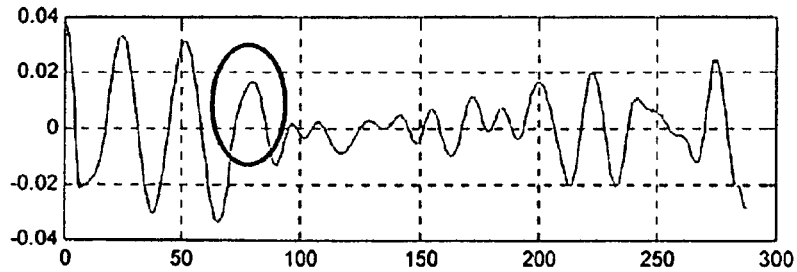

As marked with circle on the waveforms in FIGS. 7C and 7D, the waveform of the NLCG emphasizes a harmonic component more than that of the spectral difference. Therefore, a periodic structure of harmonics can be effectively preserved.

The pitch detection method according to the above-described embodiments of the present invention includes a computer-readable medium including a program instruction for executing various operations realized by a computer. The computer-readable medium may include a program instruction, a data file, and a data structure, separately or cooperatively. The program instructions and the media may be those specially designed and constructed for the purposes of the present invention, or they may be of the kind well-known and available to those skilled in the art of computer software arts. Examples of the computer-readable media include magnetic media (e.g., hard disks, floppy disks, and magnetic tapes), optical media (e.g., CD-ROMs or DVD), magneto-optical media (e.g., optical disks), and hardware devices (e.g., ROMs, RAMs, or flash memories, etc.) that are specially configured to store and perform program instructions. Examples of the program instructions include both machine code, such as produced by a compiler, and files containing high-level language codes that may be executed by the computer using an interpreter.

According to the above-described embodiments of the present invention, provided are a method for detecting a pitch in input voice signals by using a spectral difference and its spectral auto-correlation like time domain signals, a method for detecting a pitch in input voice signals by using normalized local center of gravity and its auto-spectral correlation like time domain signals, and an apparatus executing such methods.

Additionally, according to the above-described embodiments of the present invention, provided are a new pitch detection method and apparatus that allow a minimized deviation between periods, have less influence on a noise environment, and thereby improve the exactness of a pitch detection.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. A method of detecting a pitch in input voice signals implemented by a processor, the method comprising:

performing, using the processor, a Fourier transform on the input voice signals after performing a pre-processing on the input voice signals;

performing an interpolation on the transformed voice signals;

calculating a normalized local center of gravity (NLCG) on a portion of a spectrum of the interpolated voice signals in a local region, instead of the entire spectrum;

calculating a spectral auto-correlation using the calculated NLCG;

determining a voicing region based on the calculated spectral auto-correlation; and extracting a pitch using a spectral auto-correlation corresponding to the voicing region, wherein the calculating of the NLCG includes calculating the NLCG on a portion of the spectrum in the local region, instead of the entire spectrum, so that a center of gravity on a spectrum in the local region among spectrum of the interpolated voice signals is included within a predetermined range, and wherein the calculating of the spectral auto-correlation comprises automatically performing a normalization when the NLCG is included within a predetermined range, wherein the NLCG is calculated by the equation $$cA(f_i) = \frac{1}{U}\frac{\sum_{j=1}^{j=U} iA(f_{i-U/2+j})}{\sum_{j=1}^{j=U} A(f_{i-U/2+j})} - M$$

where M represents a predetermined value, A represents the voice signal, U represents the local region, f represents the spectrum and i represents a time.

2. The method of claim 1, wherein the performing an interpolation includes:

performing a low-pass interpolation with regard to amplitudes corresponding to low-pass frequencies of the transformed voice signals; and re-sampling a sequence to correspond to R times of an initial sample rate.

3. The method of claim 1, wherein the determining a voicing region includes:

comparing a maximum of the calculated spectral auto-correlation with a predetermined value; and determining, as the voicing region, a region in which the maximum calculated spectral auto-correlation is greater than the critical value.

4. The method of claim 1, wherein the extracting a pitch includes extracting the pitch by performing a parabolic interpolation or a sync function interpolation on the spectral auto-correlation corresponding to the voicing region.

5. The method of claim 4, wherein the pitch is extracted from a position of a local peak corresponding to a maximum spectral auto-correlation among interpolated spectral auto-correlations.

6. An apparatus for detecting a pitch in input voice signals, the apparatus comprising:

a processor comprising a pre-processing unit performing a predetermined pre-processing on the input voice signals;

a Fourier transform unit performing a Fourier transform on the pre-processed voice signals;

an interpolation unit performing an interpolation on the transformed voice signals;

a normalized local center of gravity (NLCG) calculation unit calculating an NLCG on a portion of a spectrum of the interpolated voice signals in a local region, instead of the entire spectrum;

a spectral auto-correlation calculation unit calculating a spectral auto-correlation using the calculated NLCG;

a voicing region decision unit determining a voicing region based on the calculated spectral auto-correlation; and a pitch extraction unit extracting a pitch using a spectral auto-correlation corresponding to the voicing region, wherein the NLCG calculation unit calculates the NLCG on a portion of the spectrum in the local region, instead of the entire spectrum, so that a center of gravity on a spectrum in the local region among spectrum of the interpolated voice signals is included within a predetermined range, and wherein the spectral auto-correlation calculation unit automatically performs a normalization when the NLCG is included within a predetermined range, wherein the NLCG is calculated by the equation $$cA(f_i) = \frac{1}{U}\frac{\sum_{j=1}^{j=U} iA(f_{i-U/2+j})}{\sum_{j=1}^{j=U} A(f_{i-U/2+j})} - M$$

where M represents a predetermined value, A represents the voice signal, U represents the local region, f represents the spectrum and i represents a time.

7. A method of detecting a pitch in input voice signals implemented by a processor, the method comprising:

performing, using the processor, a Fourier transform on the input voice signals after performing a pre-processing on the input voice signals;

performing an interpolation on the transformed voice signals;

calculating a normalized local center of gravity (NLCG) on a portion of a spectrum of the interpolated voice signals in a local region, instead of the entire spectrum;

calculating a spectral auto-correlation using the calculated NLCG;

determining a voicing region based on the calculated spectral auto-correlation; and extracting a pitch using a spectral auto-correlation corresponding to the voicing region, wherein the NLCG is calculated by the equation $$cA(f_i) = \frac{1}{U}\frac{\sum_{j=1}^{j=U} iA(f_{i-U/2+j})}{\sum_{j=1}^{j=U} A(f_{i-U/2+j})} - 0.5$$

where A represents the voice signal, U represents the local region, f represents the spectrum and i represents a time.

8. An apparatus for detecting a pitch in input voice signals, the apparatus comprising:

a processor comprising a pre-processing unit performing a predetermined pre-processing on the input voice signals;

a Fourier transform unit performing a Fourier transform on the pre-processed voice signals;

an interpolation unit performing an interpolation on the transformed voice signals;

a normalized local center of gravity (NLCG) calculation unit calculating an NLCG on a portion of a spectrum of the interpolated voice signals in a local region, instead of the entire spectrum;

a spectral auto-correlation calculation unit calculating a spectral auto-correlation using the calculated NLCG;

a voicing region decision unit determining a voicing region based on the calculated spectral auto-correlation; and a pitch extraction unit extracting a pitch using a spectral auto-correlation corresponding to the voicing region, wherein the NLCG calculation unit calculates the NLCG by the equation $$cA(f_i) = \frac{1}{U}\frac{\sum_{j=1}^{j=U} iA(f_{i-U/2+j})}{\sum_{j=1}^{j=U} A(f_{i-U/2+j})} - 0.5$$

where A represents the voice signal, U represents the local region, f represents the spectrum and i represents a time.

* * * * *